US009441405B2

(12) United States Patent
Chubb et al.

(10) Patent No.: US 9,441,405 B2
(45) Date of Patent: Sep. 13, 2016

(54) SLIDING DOOR ASSEMBLY

(75) Inventors: Richard A. Chubb, Voorhees, NJ (US); Ralph R. Wearsch, Huntersville, NC (US)

(73) Assignee: THERMOSEAL INDUSTRIES, LLC, Gloucester, NJ (US)

( * ) Notice: Subject to any disclaimer, the term of this patent is extended or adjusted under 35 U.S.C. 154(b) by 1516 days.

(21) Appl. No.: 12/658,225

(22) Filed: Feb. 4, 2010

(65) Prior Publication Data

US 2010/0192468 A1 Aug. 5, 2010

Related U.S. Application Data

(60) Provisional application No. 61/206,805, filed on Feb. 4, 2009.

(51) Int. Cl.
*E05D 15/06* (2006.01)
*E06B 7/23* (2006.01)

(52) U.S. Cl.
CPC ..... *E05D 15/0686* (2013.01); *E06B 7/2312* (2013.01); *E06B 7/2314* (2013.01); *E05Y 2900/202* (2013.01)

(58) Field of Classification Search
USPC ..... 49/61, 62, 63, 125, 408, 410, 411, 425, 49/471; 52/204.52, 209, 656, 2, 5
See application file for complete search history.

(56) References Cited

U.S. PATENT DOCUMENTS

| | | | | | |
|---|---|---|---|---|---|
| RE24,508 | E | * | 7/1958 | Grossman | 49/411 |
| 2,911,654 | A | * | 11/1959 | Bruno | 4/607 |
| 3,117,657 | A | * | 1/1964 | Bruno | 49/425 |
| 3,978,617 | A | * | 9/1976 | Eventoff | 49/404 |
| 4,432,163 | A | * | 2/1984 | Cassiere | 49/63 |
| 4,656,781 | A | * | 4/1987 | Niekrasz et al. | 49/404 |
| 4,785,485 | A | * | 11/1988 | Etesam | 4/557 |
| 5,274,955 | A | * | 1/1994 | Dallaire et al. | 49/406 |
| 7,555,871 | B1 | * | 7/2009 | Neal | 52/204.51 |

* cited by examiner

*Primary Examiner* — Brian Mattei
*Assistant Examiner* — Catherine A Kelly
(74) *Attorney, Agent, or Firm* — Francis C. Hand; Carella, Byrne et al

(57) ABSTRACT

The sliding door assembly has a non-metallic frame formed of extrusions of solid cross-section and a pair of non-metallic sashes slidably disposed in the frame to move laterally between a closed position and an open position relative to frame. The floor of the sill extrusion is sloped rearwardly and longitudinally downwardly toward a notch to direct water thereto for draining out of the frame. The frame can be dropped into a commercial refrigeration cabinet and each sash is removably mounted in the frame.

20 Claims, 10 Drawing Sheets

SLIDING DOOR ASSEMBLY

This application claims the benefit of U.S. Provisional Application Ser. No. 61/206,805, filed Feb. 4, 2009.

This invention relates to a sliding door assembly. More particularly, this invention relates to a sliding glass door assembly for refrigeration cabinets.

This application incorporates the disclosure of pending U.S. patent application Ser. No. 11/544,215, filed Oct. 6, 2006.

The sliding door assembly provides a "thinner version" of the "thicker" or "bulkier" (i.e., heavier-duty) welded PVC sliding glass door system described in pending U.S. patent application Ser. No. 11/544,215.

The sliding door assembly may be used as a door or as a window and is particularly adapted to use in refrigerated and non-refrigerated food service display cases, merchandising display cases, and other high-service (high-usage) sliding glass door/window applications.

It is an object of the invention to provide a low-cost, high-performance, door assembly that will primarily be used for the "back side" of refrigerated and non-refrigerated merchandising cases or cabinets wherein available "space" (or internal case "real estate") is at a premium and is not available for the bulkier or heavier-duty type of sliding glass doors common to larger front-of-case applications like bottle coolers.

It is an object of the invention to improve thermal performance over traditional mechanically-fastened fiberglass/PVC pultrusion or aluminum extrusion-based sliding glass door systems.

It is another object of the invention to provide a modular, one-piece welded frame assembly that can be "dropped into" a cabinet opening without the traditional multi-piece, mechanically-fastened frame assembly that is characteristic of the current state-of-the-art of commercial refrigeration sliding glass door/window technology.

It is another object of the invention to provide improved economics through the use of fusion or sonic welding of PVC (or similar weldable, non-metallic materials in lineal form) to form an assembly, instead of the more labor-intensive and costly manual assembly methods associated with traditional mechanically-fastened door systems.

It is another object of the invention to provide for positive self-draining of the frame tracks to assist with cleaning and NSF (National Sanitation Foundation) compliance, and to assist with condensation management in high humidity environments or environments where surface condensation on the exterior of the glass and door system components might otherwise occur and might run or drip or otherwise accumulate in the frame sill tracks.

It is another object of the invention to improve the ease of cleaning the sill tracks through the use of an innovative sloped-sill track, so that cleaning solutions and naturally-occurring soil are not so difficult to "mop up", because these materials will positively drain or "flow" out of the sill tracks of the door system and into the interior of the cabinet on which the door system is installed.

It is another object of the invention to create a newer version of the door assembly of the pending patent application which incorporates a dramatically "thinner" overall "footprint".

It is another object of the invention to create a door system that utilizes multiple, field-replaceable wear components, so as to minimize any requirements for complete door or frame replacement in the event of single component failure.

Briefly, the invention is directed to a sliding door assembly that is comprised of a frame and at least one sash that is slidably disposed in the frame to move laterally between a closed position and an open position relative to the frame.

The frame is made of polyvinylchloride (PVC), although the frame design could be made of other plastic or non-metallic linear materials that can be thermally or sonically welded together, and consists of three (3) separate extrusions for forming a sill (bottom), left and right jambs (side vertical frame profiles) and header (top), which can be miter-cut and fusion-welded or sonically-welded to form a one-piece frame that requires no mechanical fasteners for assembly and which can be "dropped into" a commercial refrigeration cabinet, showcase, or other "rectangular opening" without having to install and fasten individual frame members to "frame the opening".

Each sash (door) is made of polyvinylchloride (PVC) or other plastic or non-metallic linear material that can be welded, and consists of two (2) separate primary extrusions. One extrusion (common sash) is used to form the top, bottom and one vertical side of each door. The second extrusion (handle sash) is used to form the handle side of each door. Each extrusion can be miter cut and fusion-welded to form a one-piece frame that requires no mechanical fasteners for assembly.

As an alternative, the common sash PVC extrusion can be used on all four members surrounding a glass pack (or other insert material), and a separate mechanically-fastened handle can then be attached to the door where the handle sash would have been used. This would be in lieu of using the full-length extruded-in handle that is a feature of the handle sash extrusion profile.

The PVC sash extrusions incorporate a small return leg or lip on the ends of the external sash legs, which accommodate "snapping on" various accessory extrusions and/or retaining wheel housings or other sash-based attachments or features.

A PVC glazing bead accessory extrusion is provided that is "snapped into" the two sash extrusions to cover and seal over the surface of an insulating glass (IG) assembly after the IG assembly is dropped into the welded sash as part of the door assembly process.

A PVC accessory "snap-on" extrusion is also provided for covering an exposed vertical, center overlap or "meeting stile" where the two sliding doors overlap, and which provides for greatly reduced airflow (leakage) between the doors. In one embodiment, the snap-on extrusion has a fin that has an interlocking feature that creates a seal as the two opposing fins of the covers on the doors nest or interlock into each other upon closing of the doors to reduce airflow. In an alternative embodiment, use may be made of a plain sash cover on the outer door, with a sash cover on the inner door that incorporates a slot (or "kerf pocket") into which a flexible or rigid gasket material can be inserted to also accomplish reduced airflow.

As in the pending application Ser. No. 11/544,215, the bottom of each door may be provided with roller assemblies for rolling on integrated tracks built into the sill of the frame which may be covered with roll-formed or extruded metal covers (e.g., stainless steel) to reduce wear and rolling friction. To this end, use is made of a snap-In, field-Replaceable, Nylon, injection-molded, tandem wheel housing with snap-in roller wheel assemblies that can accommodate roller wheels without bearings for lighter-duty applications, or roller wheels with bearings for heavier-duty applications. Alternatively, use may be made of snap-In Nylon or UHMW (Ultra High Molecular Weight) plastic glide blocks which snap into the bottom of each door and which are grooved for self-aligning with the track guides or tracks in the sill of the frame, and which provide a low-friction "glide open" and "glide close" feature for customers that do not want self-closing doors.

As in the pending application Ser. No. 11/544,215, an injection-molded Nylon "Torpedo" or self-closing-device may be inserted into the frame header for gliding back-and-forth inside an integrated C-channel in the header and which contacts the upper portion of each door for self-closing the doors via a tension spring that is located in the C-channel in line with each door. This component, and the tension spring that attaches thereto, are required for sliding glass doors that require a self-closing feature, wherein the tension spring connects to the torpedo, which contacts the vertical sides of each door to affect the self-closing operation. This component, and the spring that attaches thereto, are not required for the non-self-closing embodiment of this design.

The frame extrusions may be provided with a grooved center and inner tower for accommodating various snap-on extrusions to provide for various sealing options, glide strips and any number of attachments to accommodate unique customer requirements.

The sill is formed with a slope to provide positive drainage of cleaning solutions or excess condensation and directing such fluids toward the interior of the cabinet during cleaning operations or excess condensation conditions (which prevents water from accumulating and spilling onto the exterior floor where consumers might slip and fall on water that overflows from the sill track of the frame). This feature simplifies cleaning of the sill track when naturally-occurring soils accumulate, and this feature greatly improves the safety associated with condensate build up and drainage in high humidity applications where the glass or door frame members might "sweat". This feature allows excess moisture to be directed toward the interior drain systems in a cabinet, or to the interior floor or "pan" of the cabinet where the refrigeration system can naturally evaporate this moisture through the standard refrigeration cycle.

The accompanying drawings illustrate the invention as follows.

Figure 1:
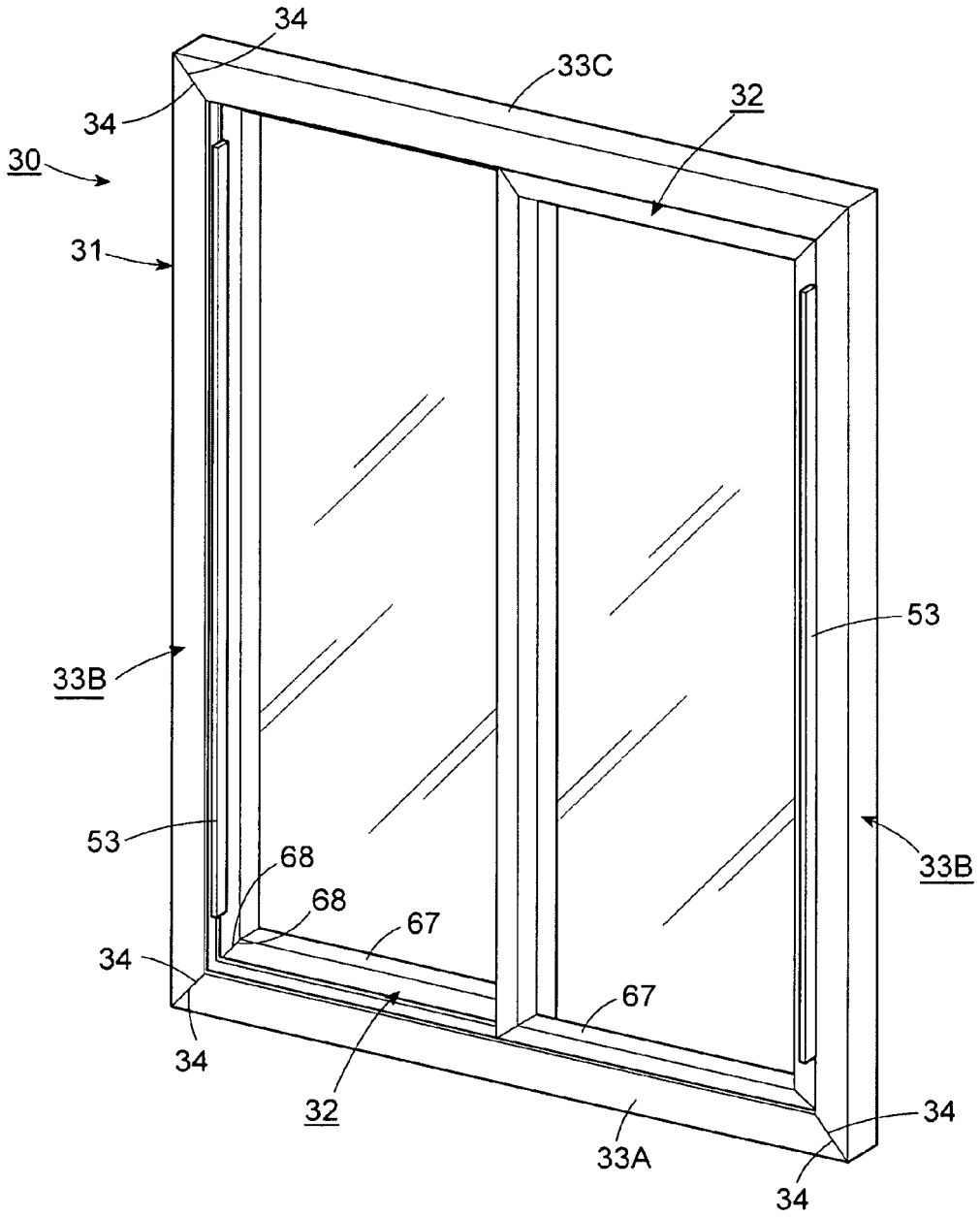
FIG. 1 illustrates a schematic front view of a sliding glass door assembly constructed in accordance with the invention for mounting in a cabinet.

Referring to FIG. 1, the sliding door assembly 30 is particularly constructed for use with insulating glass units (IGUs) but also may be made with monolithic glass (e.g., single pane) or non-glass units (e.g., foam-cored steel or fiberglass insulating panels, and the like).

The sliding glass door assembly 30 is comprised of a frame 31 and a pair of sashes (doors) 32 that are slidably disposed in the frame 31 to move laterally between a closed position and an open position relative to the frame 31.

As illustrated, the frame 31 is of rectangular shape and is constructed to fit onto or within a cabinet (not shown), for example, a refrigerated or non-refrigerated cabinet. The frame 31 is made of three types of plastic extrusion profiles 33A, 33B, 33C that are integrally secured together, as by thermal welding or where suitable by sonic welding, to define a rectangular opening with each profile 33 having a mitered end 34 integrally secured to the mitered end 34 of an adjacent profile 33.

Each of the frame profiles 33A, 33B, 33C is formed from a separate unique extrusion profile that is initially cut to length and then mitered at each end. As illustrated, each extrusion is of solid cross-section unlike the hollowed cross-sections of the frame profiles of U.S. Ser. No. 11/544,215 and each is formed with a pair of outer walls and a floor defining a channel-shaped cross-section. That is to say, the pair of outer walls and the floor each have a solid cross-section and combine to form the channel-shaped cross-section of the extrusion.

Figure 3:
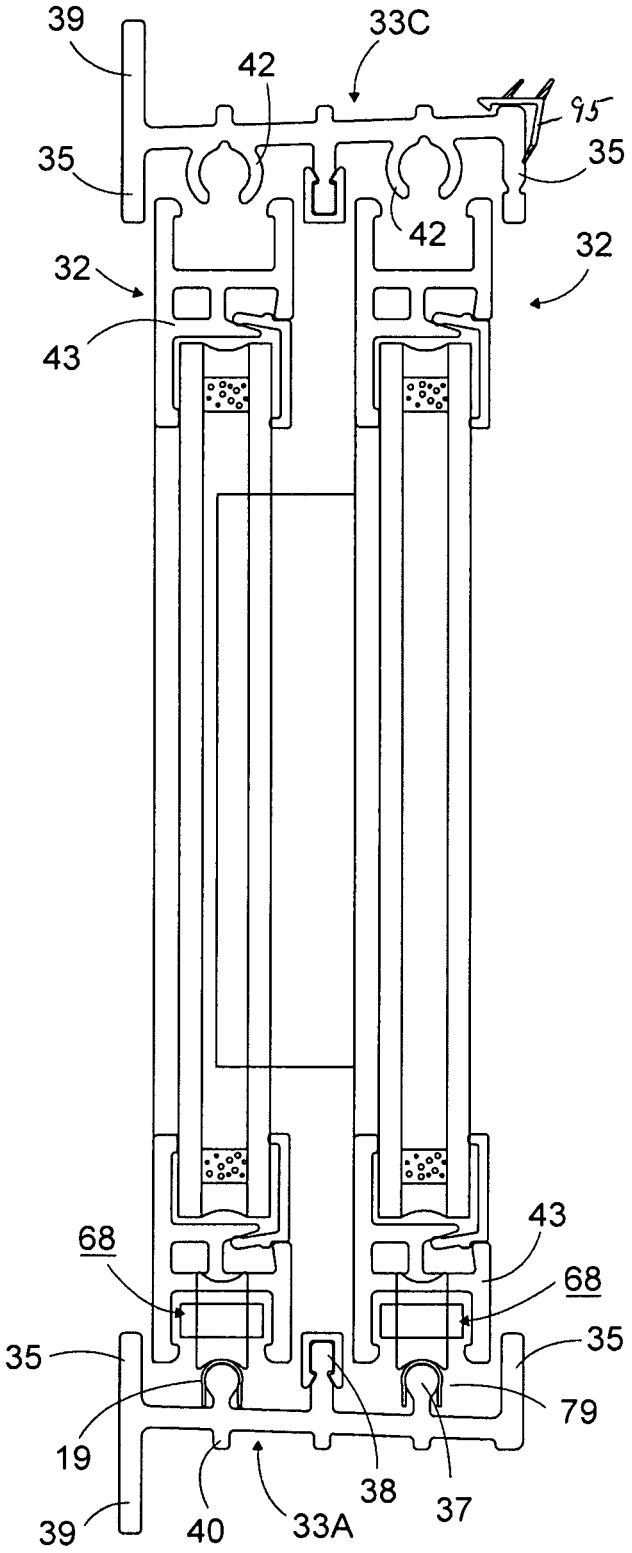
FIG. 3 illustrates a cross-sectional top view of the assembly of FIG. 1.

Referring to FIGS. 3, 4, 5 and 6, the sill frame profile 33A has a pair of outer walls 35 (or towers) and a floor 36 that define a channel-shaped cross-section. As indicated in FIG. 3, the floor 36 is sloped downwardly to the right, i.e. to the rear (or interior) of the assembly 30, as viewed, to direct water in that direction. In addition, a pair of upstanding parallel rails 37 and an upstanding rib (or tower) 38 between the rails 37 are integrated with the floor 36 for purposes described below. An outwardly extending wall 39 extends from below the floor 36 in alignment with the front wall 35 (or tower), as viewed in FIG. 3, to abut against a cabinet frame (not shown) and three reinforcing ribs (or support legs) 40 of variable length that extend from below the floor 36 in alignment with the rails 37 and rib 38. These ribs 40 create a 90° arrangement between the front wall of the extrusion and the cabinet walls to provide support for the frame 31 along with a level mounting surface.

The sloped sill frame profile 33A enables vertically-mounted door systems to "self-drain" into the interior of a cabinet in the event that high humidity causes excessive external condensation to form and to assist with positive drainage during cleaning of the door system at a customer location.

Figure 4:
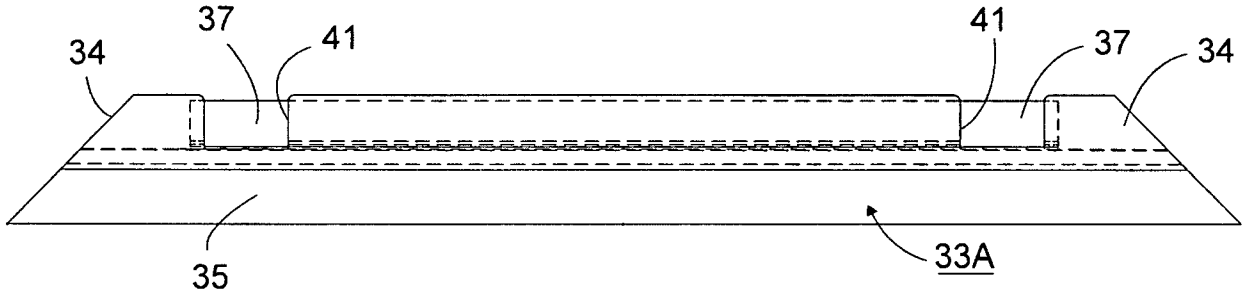
FIG. 4 illustrates a back view of the sill of the frame.
Figure 5:
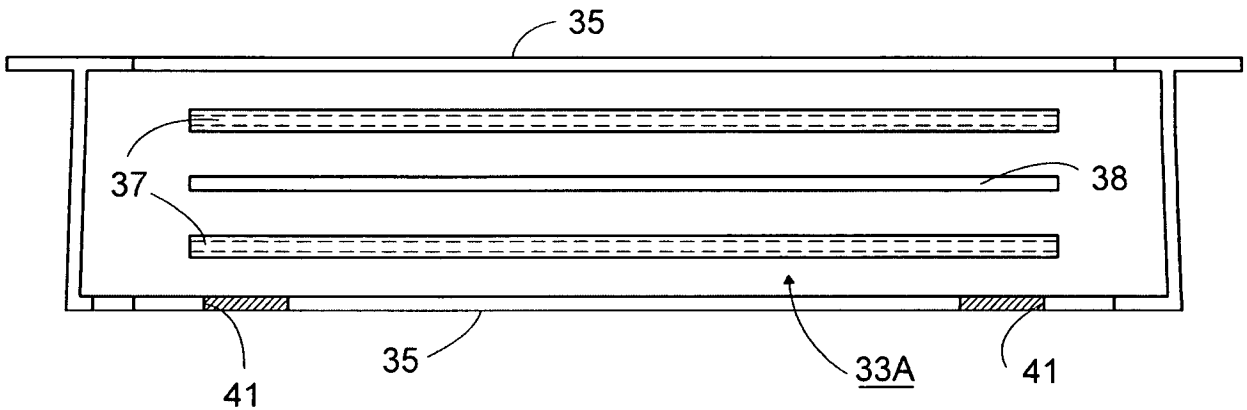
FIG. 5 illustrates a top view of the sill of FIG. 4.
Figure 6:
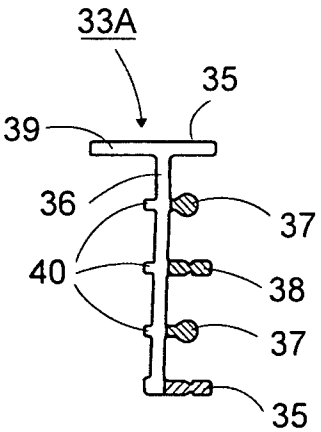
FIG. 6 illustrates a side view of the sill of FIG. 5.

As indicated in FIGS. 4 and 5, the rails 37 and rib 38 extend longitudinally along the sill profile 33A and terminate at a point short of where the side frame profiles 33B meet the sill profile 33A to provide a "notched out area" to assist in cleaning the sill profile. In addition, the rear wall 35 is provided with two notches 41 symmetrically of the length of the profile 33*a* for drainage purposes.

Figure 7:
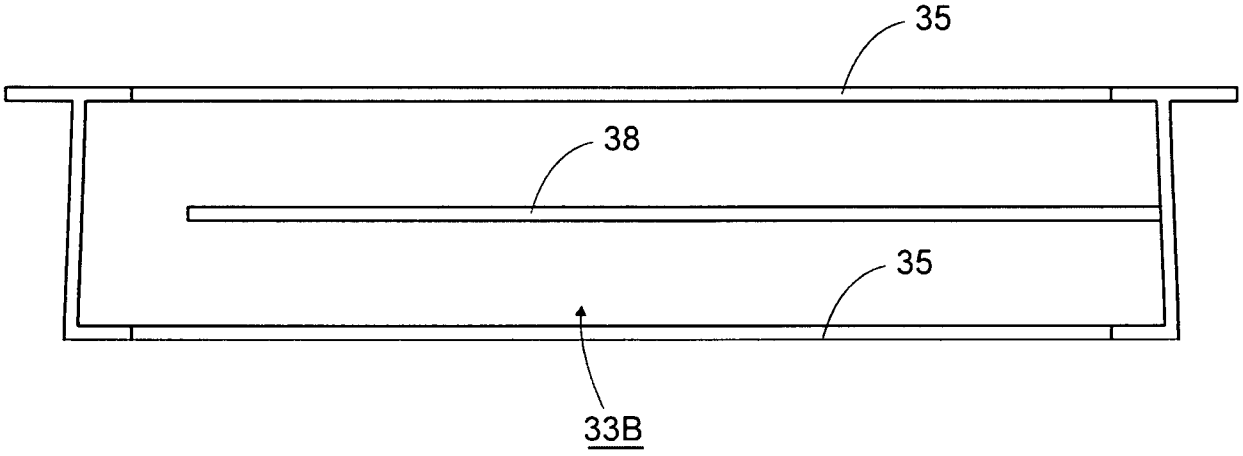
FIG. 7 illustrates a plan view of a side jamb of the frame.
Figure 8:
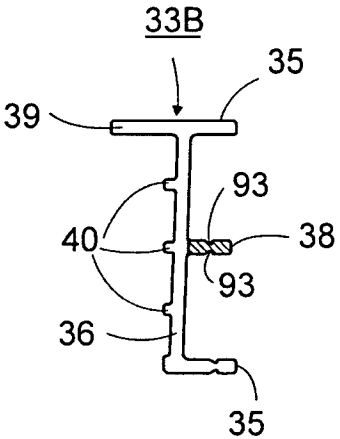
FIG. 8 illustrates an end view of the side jamb of FIG. 7

Referring to FIGS. 7 and 8, wherein like characters indicate like parts as above, each side frame profile 33B is similar to the sill profile 33A in having a floor 36, three walls (or towers) 35, 39, an upstanding rib (or tower) 38 and reinforcing ribs 40. The rib (tower) 38 disposed between the walls 35 is of less height than the walls 35 and extends from a point where the side frame profile 33B meets the sill profile 33A to the opposite end of the profile 33B.

Figure 9:
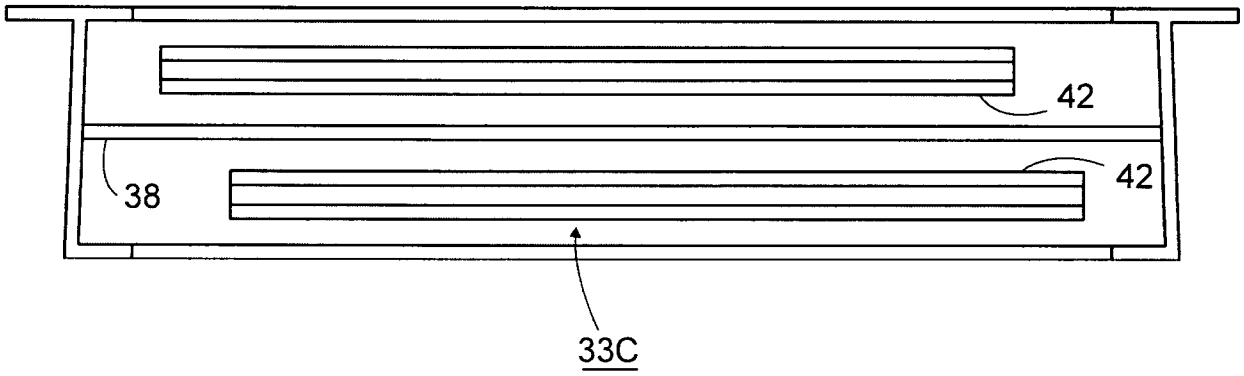
FIG. 9 illustrates a plan view of the header of the frame.
Figure 10:
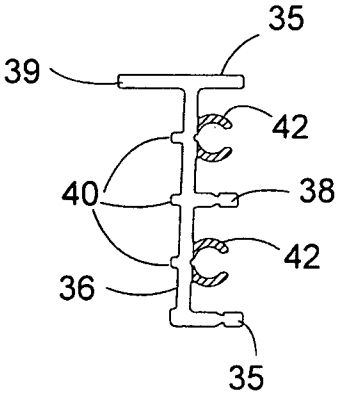
FIG. 10 illustrates an end view of the header of FIG. 9.

Referring to FIGS. 9 and 10, wherein like characters indicate like parts as above, the header profile 33C is similar to the side profile 33B in having a floor 36, three walls (or towers) 35, 39, an upstanding rib (or tower) 38 and reinforcing ribs 40. The rib (tower) 38 disposed between the walls 35 is of less height than the walls 35 and extends completely across the profile 33C. In addition, a pair of C-shaped rails 42 is integrated with the floor 36 with each rail 42 extending within a channel defined by a wall (tower) 35 and the intermediately disposed rib (tower) 38. As indicated in FIG. 9, the C-shaped rails 42 are parallel to the intermediate rib (tower) 38 while being longitudinally offset from each other. Each of these rails 42 serves to house a self-closing device (not shown) such as described in Ser. No. 11/544,215 for closing of a respective sash 32.

The ribs (towers) 38 of the sill profile 33A, side profiles 33B and header profile 33 are disposed in co-planar relation to form a continuous peripheral rib.

Figure 2:
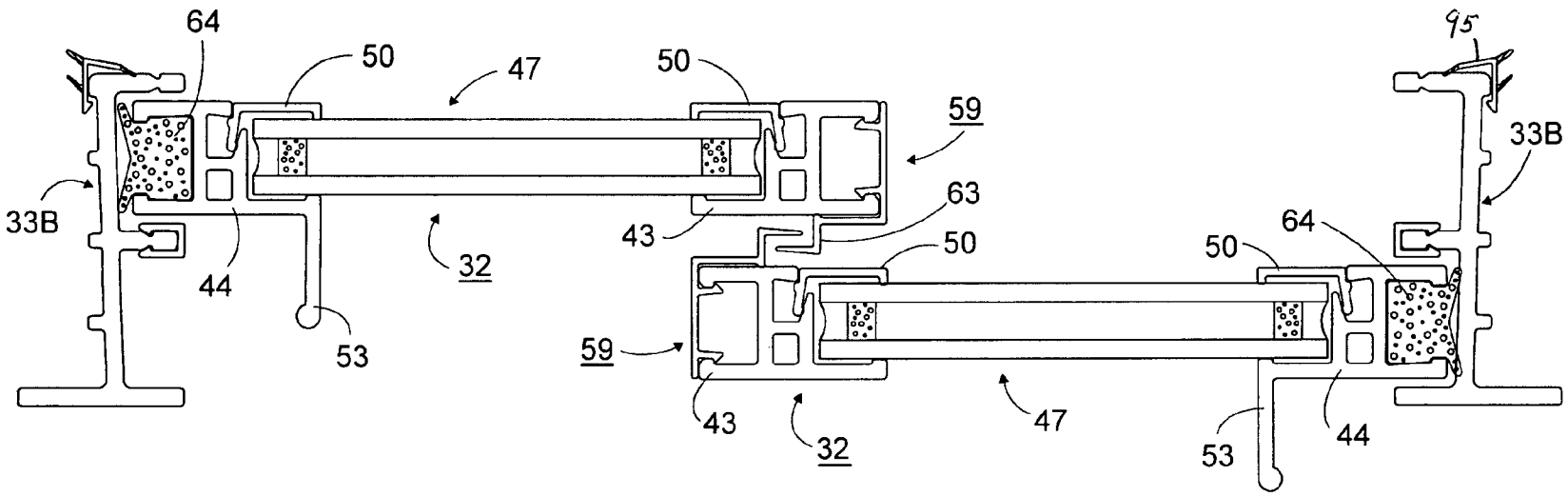
FIG. 2 illustrates a cross-sectional top view of the assembly of FIG. 1.

As indicated in FIGS. 2 and 3, the floors 36 of the four profiles 33A, 33B and 33C are sloped. The slope of the interior surface of the sill profile 33A is offset by the variable length of the short legs 40 on the back side of the floor 36. This allows the frame 31 to sit squarely (or at 90° angles) to the opening of the cabinet.

Referring to FIGS. 2 and 3, the frame 31 may be dimensioned to fit into a small footprint, such as an opening of 40 inches wide and 20 inches high in a cabinet with the outwardly extending walls 39 abutting the face of the cabinet. These walls 39 act as a stop to prevent the frame 31 from dropping further into the cabinet. The size given is simply an example, and the door systems can be made smaller, or larger, depending on customer requirements and end-use application.

Referring to FIGS. 2, 3, 11 and 12, in the illustrated embodiment, each sash 32 is formed of a plastic extrusion 43 that forms the top, bottom and one vertical side and a plastic extrusion 44 that forms the remaining vertical side. In this respect, the extrusion is first extruded to the length desired and then cut and mitered to be able to be folded to form the three sides of the sash 32.

Figure 11:
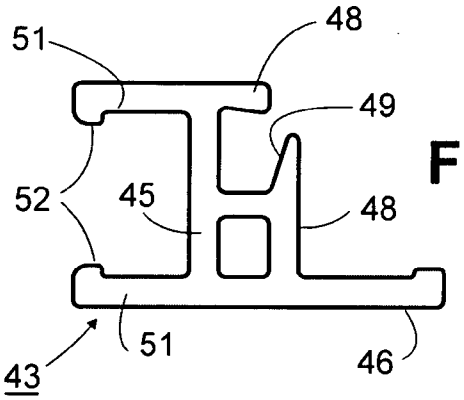
FIG. 11 illustrates a cross-sectional view of a common sash extrusion profile.

Referring to FIG. 11, the extrusion 43 has a hollow body 45 from which a flange (or glazing leg) 46 extends to define an L-shaped recess to receive an insulated glass unit (IGU) 47 (see FIG. 2) and a pair of flanges 48 that define a groove 49 extending the length of the extrusion 43 to receive a snap-in glazing bead 50 for holding the IGU 47 in place (see FIG. 2). In addition, the extrusion 43 has a pair of parallel flanges 51 that define a channel opposite the recess that receives the IG unit 46. Each flange 51 carries a small inwardly directed lip 52 at the end for purposes as described below.

Figure 12:
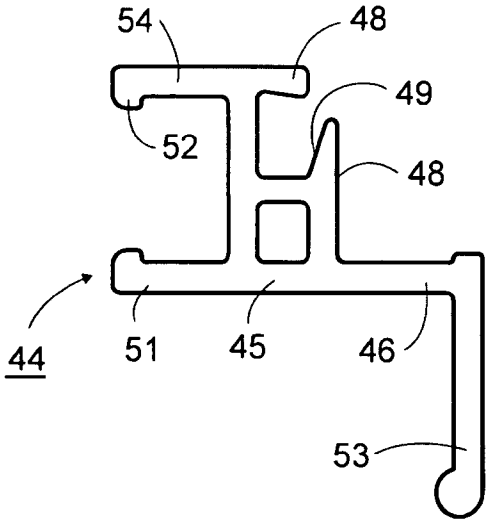
FIG. 12 illustrates a cross-sectional view of a sash extrusion profile with an integrated handle.

Referring to FIG. 12, wherein like reference characters indicate like parts as above, the extrusion 44 is identical in cross-section to the extrusion 43 and further includes an extruded-in handle 53 extending from the flange (or glazing leg) 46 that forms the recess to receive the IG unit 47. Alternatively, the extrusion 43 may form all four sides of the sash 32 with a separate handle (not shown) being secured to the flange 46 by suitable means.

Figure 13:
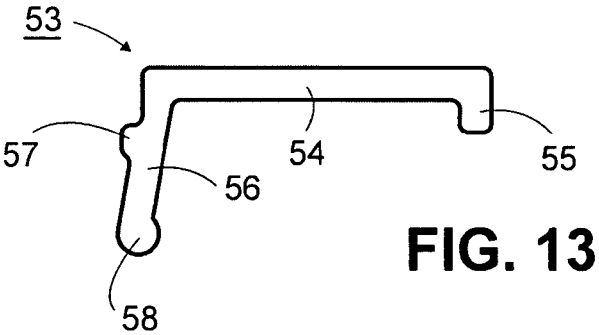
FIG. 13 illustrates a cross-sectional view of a glazing bead for holding a glass unit in a sash.

Referring to FIG. 13, four glazing beads 50 are provided, one for each of the four sides of a sash 32 to secure the IG unit 47 in place. Each glazing bead 50 is of L-shaped cross-section having a long leg 54 that overlaps the IG unit 47 and that has a lip 55 that engages against the IG unit 47 under a compressive force. Each glazing bead 50 also has a short leg 56 that is received in the recess 49 in the extrusion 43 and that has a rib 57 at an intermediate point to snap under a flange 48 of the extrusion to lock the bead 50 in place. The short leg 56 also has a rounded lip 58 at the end on a side opposite the rib 57.

Figure 14:
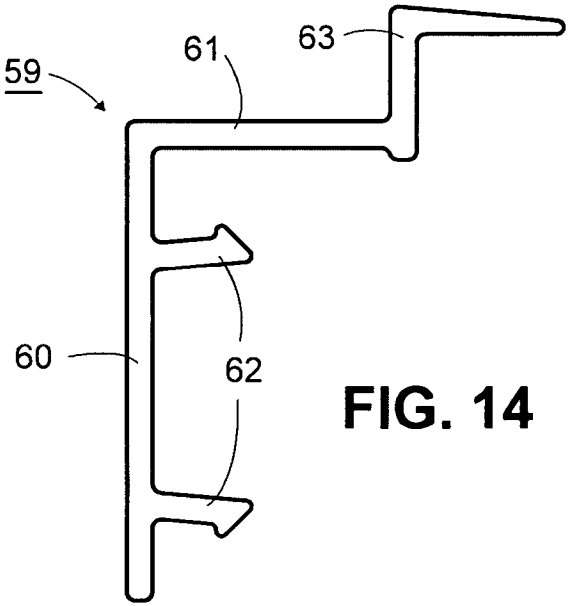
FIG. 14 illustrates a cross-sectional view of a sash interlock.

Referring to FIGS. 2 and 14, each sash 32 carries an extruded plastic panel sash interlock 59 to intermesh with the interlock of the other sash to reduce airflow between the sashes when in a closed position as shown in FIG. 2.

Referring to FIG. 14, each interlock 59 is an extruded profile having a pair of legs 60, 61 defining an L-shape, a pair of ribs 62 that extend from one leg 60 in a diverging manner relative to each other, and an L-shaped fin 63 that extends from the end of the other leg 61. As indicated in FIG. 2, the diverging ribs 62 of the interlock 59 project into the channel defined by the flanges 51 of the sash extrusion 43 and have wedge shaped ends that engage with the lips 52 on the ends of the flanges 51 to form a snap fit.

Also, when in the closed position of FIG. 2, the fins 63 of the two sashes 32 overlap to form a labyrinth seal to block the passage of air or, at least, reduce the amount of air leakage between the sashes 32.

Figure 15:
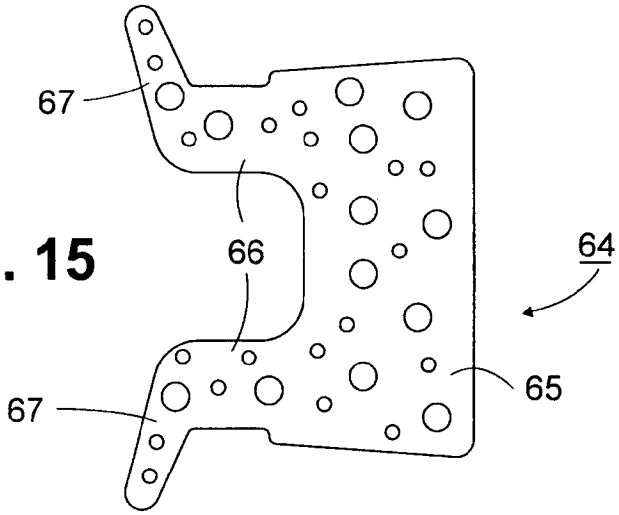
FIG. 15 illustrates a cross-sectional view of a door stop.

Referring to FIGS. 2 and 15, in one embodiment, each sash 32 carries an elongated resilient stop 64 on one side for abutting the side frame profile 33B to cushion the closure of the sash 32 against the side frame profile 33B.

As illustrated in FIG. 15, each stop 64 is made of a rectangular block body 65 having a pair of parallel flanges 66 defining a U-shaped recess along the length of the stop 64 and a pair of legs 67, each of which extends outwardly and laterally of a respective flange 66.

As indicated to the right-hand side in FIG. 2, the legs 67 of a stop 64 splay laterally outwardly when a sash 32 is closed against a side frame profile 33B. Thus, the legs 67 by splaying outwardly and the flanges 65 by compressing axially serve to dampen the closing force exerted by the closing sash 32 on the side frame profile 33B.

Each stop 64 is made of a suitable material, such as ASTM D-1056-00 2A2 EPDM sponge.

Figure 16:
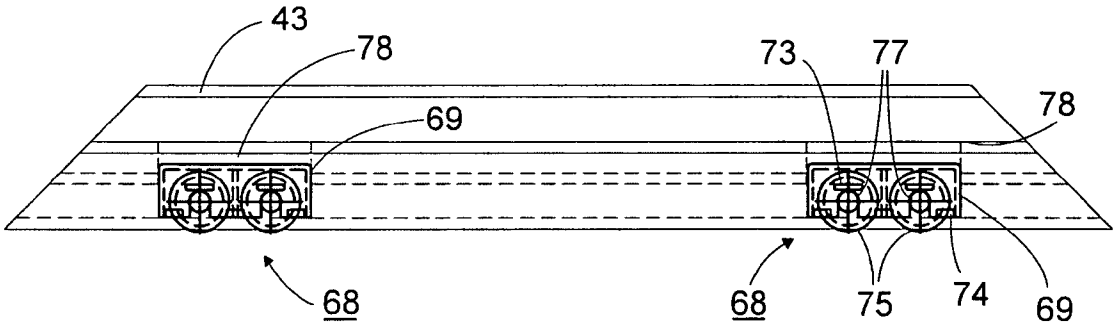
FIG. 16 illustrates a front view of the bottom sash extrusion with a pair of roller assemblies.

Referring to FIGS. 3 and 16, each sash 32 houses a pair of roller assemblies 68 within the bottom of the extrusion 43.

Referring to FIGS. 16 and 19 to 21, each roller assembly 68 includes a box-like housing 69 that defines a pair of compartments 70 separated by a common wall 71. Each side wall of the housing 69 is provided with a pair of inverted U-shaped openings 72, each of which is centrally located with respect to a compartment 70; a pair of outwardly directed tabs 73, each of which is located immediately above an opening 72; and three outwardly directed wedge shaped projections 74, each of which is located at a bottom edge of the side wall in longitudinally spaced apart manner.

Figure 18:
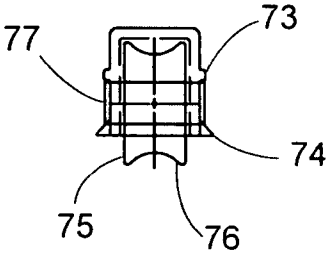
FIG. 18 illustrates an end view of a roller unit for mounting in a roller assembly of FIG. 16.
Figure 21:
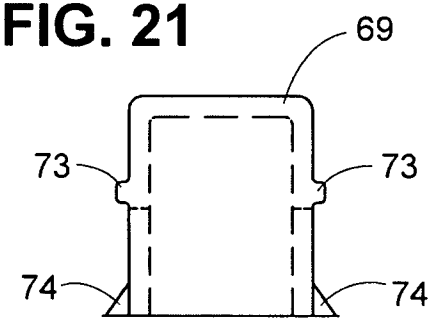
FIG. 21 illustrates an end view of a housing for the roller unit of FIG. 18.

Referring to FIGS. 16 and 18, a pair of rollers 75 is disposed in each housing 69. As indicated, each roller 75 may be made of plastic, such as Delrin®, and has a concave outer annular surface 76 and an axle 77, for example of brass, that projects from opposite sides of the roller 75. Each axle 77 is snap-fitted into the oppositely disposed inverted U-shaped openings 72 of a housing 69 so as to rotate therein as the roller 75 rolls along a rail 37 of the sill profile 33A (see FIG. 3).

Figure 17:
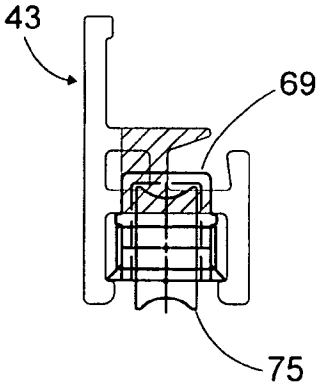
FIG. 17 illustrates an end view of the bottom sash extrusion of FIG. 16.

Referring to FIGS. 16 and 17, the sash extrusion 43 is provided with a punched hole (or slot) 78 for each roller assembly 68 so that each roller assembly 68 may be snap-fitted into the extrusion 43 by passing upwardly between the flanges 51. In this respect, the tabs 73 on the housing 69 pass between the lips 52 at the ends of the flanges 51 and butt against the base of the body 45. At the same time, the wedge shaped projections 74 cause the flanges 51 to flex outwardly to allow passage of the projections 74. Upon flexing inwardly the lips 52 block a reverse movement of the projections 74.

Referring to FIG. 3, a stainless steel cover 79 is mounted over each rail 37 for rolling of a roller 75 thereon.

The mounting of each roller assembly 68 is such that a roller 75 may be readily removed without removing the plastic housing 69 should the roller 75 need replacing.

The roller assemblies 68 provide for smooth rolling and low resistance and allow for installation without mechanical fasteners and allow for the wheel housings 69 to be field-replaceable without special hardware in the event of wear or damage. Likewise, the open wheel housing 69 allows the roller 75 to be replaced without having to remove the entire housing 68 in the event of roller damage.

Referring to FIGS. 2 and 3, each sash 32 is provided with an insulating glass unit (IGU) 47 that is dropped into place against the flange 46 forming the ledge of the sash 32 and is held in place by the four glazing beads 50. Depending on the use of the assembly 30, the IG unit 47 may have small dimensions. Typical cabinet openings are 20-30" high and 48", 72", 96", 120" and 144" wide. A typical user uses a 4 foot wide version, and a 6 foot wide version, and then uses one or more of these to "fill the hole" of a cabinet opening, as needed. However, these same sliders could go into a bottle cooler-type opening that might be 36" wide by 48"-60" tall.

The snap-in glazing bead construction combined with the drop-in construction of the insulating glass unit (IGU) enables the insulating glass units (IGUs) 47 to be field-replaceable if damaged, worn-out, or if end user simply desires to replace them for to improve performance, extend the life of the unit, update marketing presentation, and the like.

After each of the frame 31 and two sashes 32 have been fabricated, each sash 32 is fitted into the frame 31. In this respect, with a sash 32 held at an angle, the flanges 51 at the top end of the sash 32 are fitted into the recesses defined to either side of the mounting channel 45 in the header profile 33C between one of the end walls 35 and the intermediate wall 38. After moving the self-closing device out of the way, the sash 32 is then lifted and rotated so that the bottom end of the sash 32 can be dropped into place on the sill profile 33A, that is between end wall 35 and intermediate wall 38 to rest the roller assemblies 68 on the stainless steel covers 79 on the rails 37.

Thereafter, the second sash 32 is fitted into place in the frame 31 in the same manner.

In order to obtain access to a refrigerated cabinet upon which the door assembly is mounted, the user simply moves the handle 53 of a sash 32 from the closed position to an open position.

The sash 32 closes operates smoothly under the self-closing devices (not shown).

As indicated in FIGS. 2 and 3, the two sashes 32 are sealed relative to the frame 31 and relative to each other by the respective seals fins 63 to provide an efficient air-tight sealing system. The performance of the seals is sufficient to pass current industry standard thermal performance specifications for condensation prevention combined with required refrigeration requirements for cooling and maintaining product.

Figure 22:
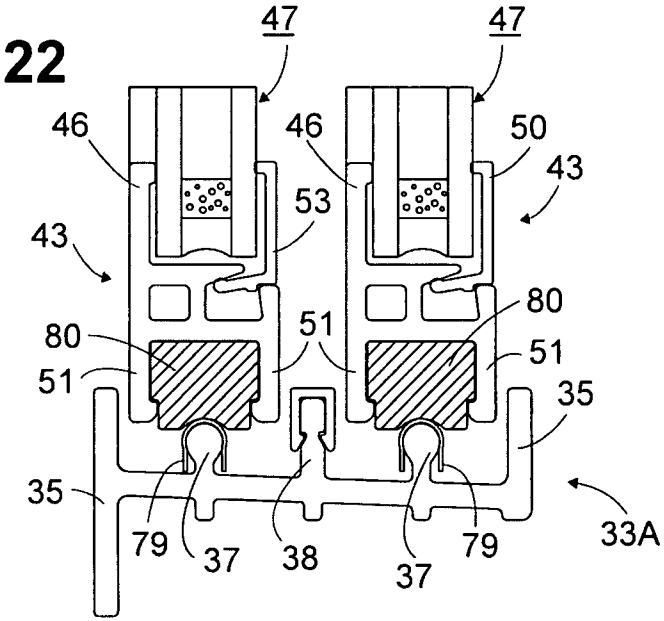
FIG. 22 illustrates a cross-sectional view of a bottom sash extrusion with a glide block for sliding on the sill of the frame for use in a non-self-closing version of the sliding glass door system.
Figure 19:
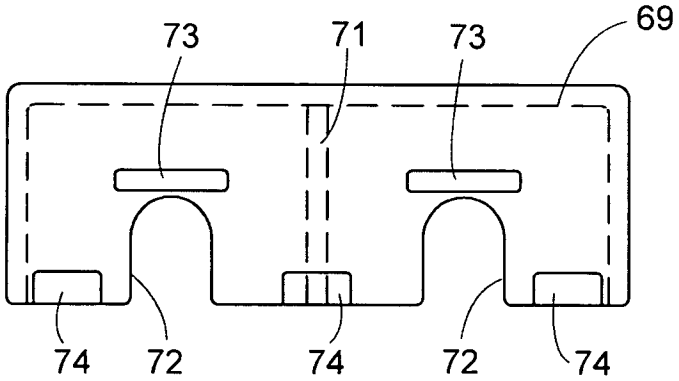
FIG. 19 illustrates an end view of a housing of a roller assembly.
Figure 20:
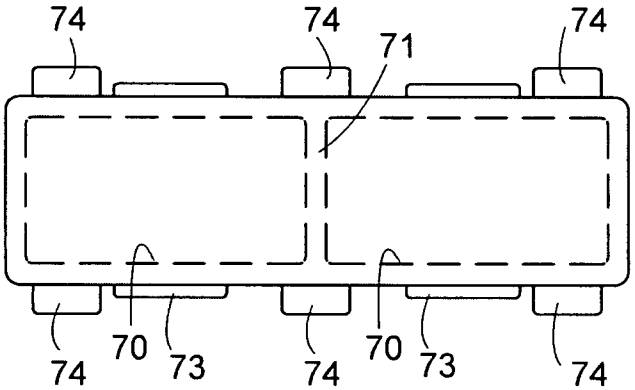
FIG. 20 illustrates a top view of the housing of FIG. 19.

Referring to FIG. 22, wherein like reference characters indicate like parts as above, instead of using a roller assembly 68 as described above, use may be made of a bearing block 80, such as one made of UHMW (Ultra High Molecular Weight Plastic, e.g., Delrin, Teflon, HDPE, and the like), for slidably mounting a sash 32 on a rail 37. As indicated, the block 80 is snap-fitted into the recess defined between the flanges 51 of the extrusion 43 for sliding along the cover 79. Any other removably mounted bearing material may also be used.

Figure 23:
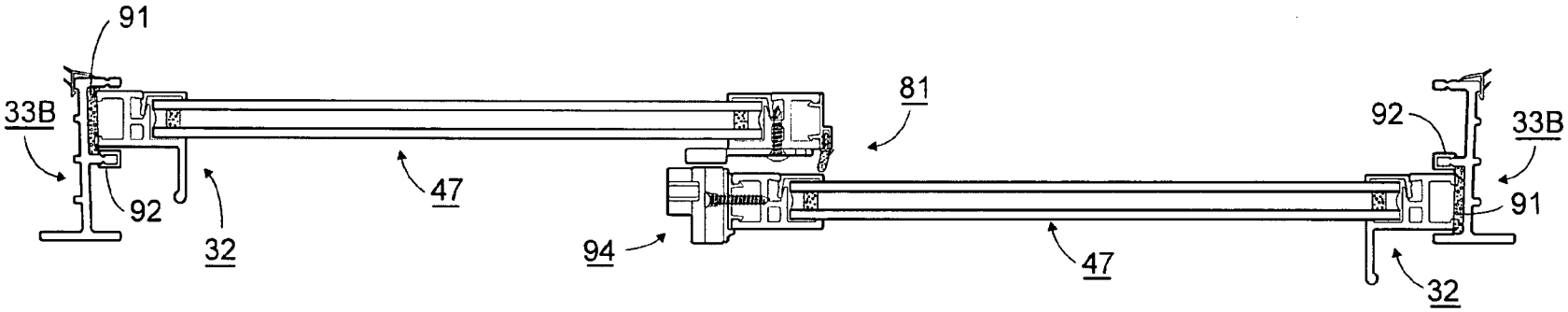
FIG. 23 is a view similar to FIG. 2 with a modified sash seal assembly.

Referring to FIG. 23, instead of using the overlapping fins 63 of the interlocks 59, use is preferably made of a seal assembly 81 to seal the gap between the two sashes 32.

Figure 25:
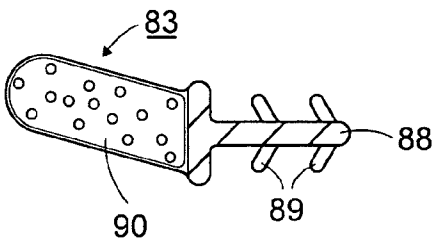
FIG. 25 illustrates a cross-sectional view of a bulb seal for mounting in the pocket of the sash cover of FIG. 24.
Figure 24:
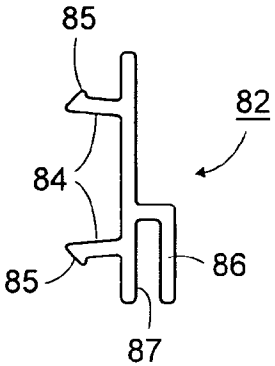
FIG. 24 illustrates a cross-sectional view of a sash cover that incorporates a kerf pocket for subsequent insertion of a bulb seal for the seal assembly of FIG. 23.

Referring to FIGS. 24 and 25, the inner door seal assembly 81 is made of a sash cover 82 that is secured to one end of the inner door (or sash) 32 and a resilient seal 83, such as a bulb seal, that is installed in the sash cover 82 to close against or be in close proximity to the opposite door (or sash) 32.

As indicated in FIG. 24, the sash cover 82 is made of plastic with a skeletal cross-section having a pair of resilient flanges 84, each of which has an outwardly directed lip 85, for snap-fitting into the recess between the flanges 51 of the sash extrusion 43. The lips 85 of the flanges 84 engage with the lips 52 on the flanges 51 to retain the seal cover 82 in place.

The sash cover 82 also has an L-shaped flange 86 defining a recess or kerf pocket 87 with the body of the cover 82 to receive the seal 83.

Referring to FIG. 25, the seal 83 has a plastic body 88 of T-shaped cross-section that has a pair of resilient fingers 89 extending angularly of the stem of the body 88. The body 88 is received in the recess 87 of the cover 82 with the fingers 89 flexed inwardly. The resilient nature of the fingers 89 exert a compressive force on the cover 82 to hold the bulb seal 83 in place.

The seal 83 also has a resilient seal portion 90, for example of foamed material, that is extruded onto and that extends from the crossbar of the body 88 outside the recess 87 to sealingly engage a glazing bead 50 securing the IG unit 47 in the opposite sash 32.

Referring to FIG. 23, instead of using a stop 64 as described above, a bumper strip 91 of foam material is preferably adhesively secured to each side frame profile 33B within a channel between the rib 38 and a wall 35 to be abutted against by a sash 32 upon closing. Also, a sash glide strip 92 of U-shape may be snap-fitted over the rib 38 to guide a sash 32 into a closed position. The glide strip 92 may have small inwardly directed wedge shaped lip at the end of each leg thereof for fitting into a mating groove 93 on the rib 38 (see FIG. 8).

As indicated in FIG. 23, locking arrangement 94 of suitable construction, for example, of key-type may also be provided to lock the sashes 32 against opening.

Referring to FIGS. 2 and 3, use may be made of clips with fins 95 on the Interior corners of the frame 31. These clips 95 are a separate PVC extrusion, a so-called push-in side seal, which is a dual-Durometer PVC Extrusion (i.e., two different types of PVC, one that is rigid, and one that is flexible) which can be easily cut-to-length with scissors or a knife. The extrusion can then be pushed in between a cabinet and the PVC frame 31 so that a customer can avoid the need to caulk the joint between the frame 31 and the cabinet around the perimeter of the door system. The clips 95 serve to avoid a need for silicone filleting of the joint between the frame 31 and the cabinet.

The invention thus provides a fully assembled sliding door assembly that can be readily installed by an end user, for example, on a refrigerated cabinet and that utilizes components that can be readily replaced in the field should the components become damaged or worn.

The invention further provides a door assembly employing a frame and a sash made substantially completely of plastic, that does not require supplemental insulation against heat transfer between the sash and frame, and that does not require electrical insulation against electrical shock in the frame.

The drop-in glazing technology with snap-on glazing bead accommodates field-replacement of the insulating glass unit in the event glass were to break, scratch or otherwise become damaged, without requiring replacement of the entire door.

The invention allows manufacturing cost savings associated with the ability to produce a fusion-welded, non-mechanically-fastened PVC frame and door system on highly automated manufacturing equipment. In particular, the invention provides modular, field-replaceable wear components.

The frame and sash constructions are energy efficient all-plastic frame and sash constructions that eliminate the need for thermally conductive steel or aluminum stiffeners, and thermally-conductive metallic corner keys, and the like.

What is claimed is:

1. A sliding door assembly comprising a non-metallic frame including a plurality of extrusions integrally secured together to form a one-piece rectangular frame with a first extrusion of said plurality of extrusions forming a sill, a second extrusion of said plurality of extrusions forming a left jamb, a third extrusion of said plurality of extrusions forming a right jamb and a fourth extrusion of said plurality of extrusions forming a header, each said extrusion having a pair of outer walls of solid cross-section and a floor of solid cross-section defining a channel-shaped cross-section;

a pair of non-metallic sashes slidably disposed in said frame to move laterally between a closed position and an open position relative to said frame.

2. A sliding door assembly as set forth in claim 1 wherein one of said walls of said first extrusion has a notch at one longitudinal end thereof and said floor is sloped downwardly toward said notch to direct water thereto for draining out of said first extrusion.

3. A sliding door assembly as set forth in claim 2 wherein said first extrusion further has an outwardly extending wall extending from said floor in alignment with one of said outer walls to abut against a cabinet frame.

4. A sliding door assembly as set forth in claim 3 wherein said first extrusion further has a pair of upstanding parallel rails and an upstanding rib between said rails integrated with said floor.

5. A sliding door assembly as set forth in claim 4 wherein said floor of said first extrusion is sloped rearwardly relative to said frame to direct water to said notch and said first extrusion further has a plurality of reinforcing ribs of variable length extending from said floor in alignment with said rails and said rib and on an opposite side of said floor from said rails.

6. A sliding door assembly as set forth in claim 1 wherein said first extrusion further has a pair of upstanding parallel rails and an upstanding rib between said rails integrated with said floor and extending in spaced relation to each of said second extrusion and said third extrusion to provide a notched out area.

7. A sliding door assembly as set forth in claim 6 wherein each said sash has a pair of roller assemblies removably mounted therein, each said roller assembly having a roller mounted on a respective one of said rails of said first extrusion.

8. A sliding door assembly as set forth in claim 6 wherein each said sash has a pair of bearing blocks removably mounted therein, each said bearing block being slidably mounted on a respective one of said rails of said first extrusion.

9. A sliding door assembly as set forth in claim 1 wherein said fourth extrusion has an outwardly extending wall extending from said floor in alignment with one of said outer walls to abut against a cabinet frame and said floor thereof is sloped rearwardly relative to said frame.

10. A sliding door assembly as set forth in claim 9 wherein said fourth extrusion has an upstanding rib integrated with said floor between said pair of outer walls thereof and a pair of C-shaped rails integrated with said floor thereof and on opposite sides of said rib thereof, each said C-shaped rail being longitudinally offset from the other of said C-shaped rails.

11. A sliding door assembly as set forth in claim 1 wherein each sash carries an extruded plastic panel sash interlock to intermesh with said interlock of the other sash to reduce airflow between said sashes when in a closed position in said frame.

12. A sliding door assembly as set forth in claim 11 wherein each interlock is fitted onto a respective sash and has an L-shaped fin extending in an overlapping relation with said L-shaped fin of the other sash in said closed position.

13. A sliding door assembly as set forth in claim 1 further comprising a sash cover fitted onto a side of one of said sashes and a resilient seal mounted in said sash cover and facing the other of said sashes.

14. A sliding door assembly as set forth in claim 1 wherein each sash carries an elongated resilient stop on one side for abutting a respective one of said second extrusion and said third extrusion to cushion the closure of said respective sash thereagainst.

15. A sliding door assembly as set forth in claim 14 wherein each stop is a rectangular block body having a pair of parallel flanges defining a U-shaped recess along the length thereof and a pair of legs, each said leg extending outwardly and laterally of a respective flange for splaying laterally outwardly when closed against a respective one of said second extrusion and said third extrusion.

16. A sliding door assembly as set forth in claim 1 wherein each said sash defines an L-shaped recess for receiving an insulated glass unit and which further includes a glazing bead for retaining an insulated glass unit in said recess.

17. A sliding door assembly comprising a non-metallic frame including a plurality of extrusions integrally secured together to form a one-piece rectangular frame with a first extrusion of said plurality of extrusions forming a sill, a second extrusion of said plurality of extrusions forming a left jamb, a third extrusion of said plurality of extrusions forming a right jamb and a fourth extrusion of said plurality of extrusions forming a header, each said extrusion having a pair of outer walls of solid cross-section and a floor of solid cross-section defining a channel-shaped cross-section;

at least one non-metallic sash removably mounted in said frame between said first extrusion and said fourth extrusion to move laterally on said first extrusion between a closed position and an open position relative to a respective one of said second extrusion and said third extrusion, said sash defining an L-shaped recess for receiving an insulated glass unit; and a glazing bead for retaining the insulated glass unit in said recess of said sash.

18. A sliding door assembly as set forth in claim 17 wherein said frame is made of polyvinylchloride (PVC) and said sash is made of polyvinylchloride (PVC).

19. A sliding door assembly comprising a non-metallic frame including a plurality of extrusions integrally secured together to form a one-piece rectangular frame with a first extrusion of said plurality of extrusions forming a sill, a second extrusion of said plurality of extrusions forming a left jamb, a third extrusion of said plurality of extrusions forming a right jamb and a fourth extrusion of said plurality of extrusions forming a header, each said extrusion having a pair of inwardly directed outer walls of solid cross-section and a floor of solid cross-section defining a channel-shaped cross-section, each said extrusion having an outwardly extending wall extending from said floor thereof in alignment with one of said outer walls thereof to abut against a cabinet frame and a plurality of reinforcing ribs of variable length extending from said floor thereof on an opposite side from said rails; and a pair of non-metallic sashes slidably disposed in said frame to move between a respective pair of said walls of said first extension and said fourth extension of said frame laterally between a closed position and an open position relative to said frame.

20. A sliding door assembly as set forth in claim 19 wherein each sash carries an elongated resilient stop on one side for abutting a respective one of said second extrusion and said third extrusion to cushion the closure of said respective sash thereagainst and wherein each stop is a rectangular block body having a pair of parallel flanges defining a U-shaped recess along the length thereof and a pair of legs, each said leg extending outwardly and laterally of a respective flange for splaying laterally outwardly when closed against a respective one of said second extrusion and said third extrusion.

* * * * *